US012703899B2

(12) United States Patent
Garcia et al.

(10) Patent No.: US 12,703,899 B2
(45) **Date of Patent: *Aug. 11, 2026**

(54) NBC-BASED CEMENTED CARBIDE

(71) Applicant: HYPERION MATERIALS & TECHNOLOGIES (SWEDEN) AB, Stockholm (SE)

(72) Inventors: Luis Fernando Garcia, Barcelona (ES); Cristina Furio Badia, Barcelona (ES)

(73) Assignee: HYPERION MATERIALS & TECHNOLOGIES, INC., Worthington, OH (US)

( * ) Notice: Subject to any disclaimer, the term of this patent is extended or adjusted under 35 U.S.C. 154(b) by 352 days.

This patent is subject to a terminal disclaimer.

(21) Appl. No.: 17/642,420

(22) PCT Filed: Nov. 24, 2020

(86) PCT No.: PCT/IB2020/061087

§ 371 (c)(1),
(2) Date: Mar. 11, 2022

(87) PCT Pub. No.: WO2021/105875

PCT Pub. Date: Jun. 3, 2021

(65) Prior Publication Data

US 2022/0341007 A1 Oct. 27, 2022

(30) Foreign Application Priority Data

Nov. 28, 2019 (GB) ..... 1917347

(51) Int. Cl.
*C22C 29/06* (2006.01)
*C22C 1/051* (2023.01)

(52) U.S. Cl.
CPC ..... *C22C 29/067* (2013.01); *C22C 1/051* (2013.01); *B22F 2301/15* (2013.01); *B22F 2302/10* (2013.01)

(58) Field of Classification Search
None
See application file for complete search history.

(56) References Cited

U.S. PATENT DOCUMENTS

2020/0102634 A1 * 4/2020 Polese ..... C21D 10/005

FOREIGN PATENT DOCUMENTS

| | | | | | |
|---|---|---|---|---|---|
| CN | 1477222 | A | * | 2/2004 | |
| CN | 109136714 | A | | 1/2019 | |
| CN | 109338193 | A | | 2/2019 | |
| CN | 109402479 | A | * | 3/2019 | ..... C22C 1/051 |
| CN | 109439991 | A | | 3/2019 | |
| CN | 109439992 | A | | 3/2019 | |
| CN | 112746212 | A | * | 5/2021 | ..... C22C 1/051 |
| EP | 3398703 | A | | 11/2018 | |
| EP | 3398703 | A1 | * | 11/2018 | ..... B22F 5/00 |
| JP | S63286550 | A | | 11/1988 | |
| JP | 05098383 | A | * | 4/1993 | |
| JP | H0598383 | A | | 4/1993 | |
| JP | 2001181775 | A | | 7/2001 | |
| JP | 2007069309 | A | | 3/2007 | |
| WO | WO-2018215996 | A1 | * | 11/2018 | ..... C22C 29/08 |

OTHER PUBLICATIONS

CN 109439991 machine translation (Year: 2019).*
JP H05-0098383 machine translation (Year: 1993).*
CN 109439992 machine translation (Year: 2019).*
JP S63-286550 machine translation (Year: 1988).*
CN 1477222 machine translation (Year: 2004).*
Suzuki et al. Journal of the Japan Society of Powder and Powder Metallurgy. (1981), 28(5), 179-182. (Year: 1981).*
Warren et al. Microstructural development during the liquid-phase sintering of cemented carbides. I. Wettability and grain contact. Powder Metallurgy (1972), 15(30), 166-180. STN Abstract (Year: 1972).*
Suzuki et al. Journal of the Japan Society of Powder and Powder Metallurgy. (1981), 28(5), 179-182. Machine English translation. (Year: 1981).*
Garcia, Jose et al., "Cemented Carbide Microstructures: a review", International Journal of Refractory Metals and Hard Materials, vol. 80, pp. 40-68, Dec. 10, 2018.

* cited by examiner

*Primary Examiner* — Stephani Hill
(74) *Attorney, Agent, or Firm* — Ari G. Zytcer

(57) ABSTRACT

Provided is a NbC based cemented carbide and method of manufacture the same. The NbC based cemented carbide may be devoid of WC. The NbC based cemented carbide may be devoid of Co in the binder phase. The NbC based cemented carbide exhibits enhanced strength and thermal conductivity while maintaining desired toughness and hardness.

5 Claims, No Drawings

NBC-BASED CEMENTED CARBIDE

This is a National Phase Application filed under 35 U.S.C. 371 as the national stage of PCT/IB2020/061087 filed on Nov. 24, 2020, an application claiming the benefit of GB Application No. 1917347.5, filed on Nov. 28, 2019, the entire content of each of which is hereby incorporated by reference in its entirety.

FIELD OF THE DISCLOSURE

The present subject matter relates to a niobium carbide-based cemented carbide and method of manufacturing and in particular, although not exclusively, to a cemented carbide having desired mechanical properties for use in metal forming applications, such as wire drawing, rolling and tooling, as well as metal cutting applications.

BACKGROUND

Cemented carbides are hard materials that include a hard phase, which is typically hexagonal WC based, along with a ductile metallic binder, which is typically Co-based. Such carbides are commonly referred to as WC—Co based or WC—Co cemented carbides. WC—Co based cemented carbides are widely used hard materials for a broad range of applications such as metal cutting and metal forming due to their excellent hardness, toughness and strength, which yields a favorable Transverse Rupture Strength (TRS) value. To improve the mechanical properties and refine the WC grain size, transition metal carbides may be added in small quantities.

However, recently, cobalt and tungsten oxides have been identified as having mutagenic, carcinogenic and reproductive toxicity. These oxides may be present as secondary products during WC—Co cemented carbide production. Accordingly, work has been done to identify alternative materials that may be used as a substitute for WC—Co cemented carbides.

Cermets, for example, have been explored as a substitute for WC—Co cemented carbides. In high demanding applications, such as the metal cutting industry, cermets are defined as a composite material typically designed TiC- or Ti(C,N)-based composites with an fcc hard phase and a Co, Ni or Co/Ni-based binder phase. Like cemented carbides, cermets may also include transition metal carbides, usually in higher quantities compared to WC—Co cemented carbides. However, cermets' sintering cycle is more complicated than that of cemented carbides with respect to the various temperature dwells as well as to the sintering atmosphere. Usually cermets need higher sintering temperatures because of the more stable character of cermet hard phases. Furthermore, if nitrogen is in the starting formulation, the outgassing of nitrogen (at higher temperature than the CO outgassing temperature) can give rise to nitrogen porosity. Thus, cermets usually present a sintering cycle that is more complicated and difficult to control than that of cemented carbides.

Niobium carbide is generally known for its use as a secondary carbide phase in hardmetals. Its addition usually serves either as a grain refiner or as a secondary hard phase, sometimes known as gamma phase, helping to enhance wear resistance, limit grain growth and improve hot hardness. Compared to WC and Ti(C,N), NbC has a higher melting point, which yields high values for hot hardness. NbC has substantially low density of around 7.79 g/cm$^3$, which is comparable to steel and about half that of WC (15.63 g/cm$^3$).

Niobium, unlike tungsten, is known to be one of the most biocompatible metals. Additionally, Ni powders do not have the same hazardous classification as Co powders.

Like tungsten, niobium may also be used as a hard phase material in cemented carbides or cermets. For example, CN 109439992 discloses a NbC—Ni—$Mo_2C$ high temperature hard alloy to reduce crater wear during material processing of an iron-based workpiece. JP 05098383 discloses a cemented carbide suited for decorative materials consisting of NbC, Ni, TaC, Mo and Cr.

CN 109402479 discloses a NbC-based cermet alloy comprising in wt % 35-90 NbC, 5-30 WC and 5-55% (Nb,M)C wherein M may be any of Mo, W, Ta, Ti, Zr, Cr, V.

However, for high demanding applications such as metal cutting and metal forming, existing compositions are not suitable because of their low and unfavorable TRS values. Thus, there is a need to develop new NbC-based cemented carbides that addresses these problems.

SUMMARY

The present disclosure is directed to niobium carbide-based cemented carbide materials that are substantially free of Co and WC and have mechanical properties that are advantageous for high demand applications such as metal forming and cutting. It is an objective of the present disclosure to provide a niobium carbide-based cemented carbide material suitable for use in metal forming applications such as wire drawing, rolling and tooling, as well as metal cutting applications. It is a specific objective to provide a niobium carbide-based cemented carbide having enhanced TRS and thermal conductivity whilst exhibiting desired toughness and hardness.

Cemented carbide materials according to the present disclosure may comprise a hardness in a range of about 1300 to 1700 HV30 (ISO 3878:1983). Additionally, the present cemented carbides may comprise a toughness between about 7 to 10 MPa$\sqrt{m}$ (Palmqvist, ISO 28079:2009).

Additionally, the present cemented carbides may comprise a TRS greater than about 1300 MPa (ISO 3327:2009), based on Type A test pieces of rectangular cross-section. As will be appreciated, TRS testing is the easiest and most common procedure of analyzing the mechanical strength of carbides. In accordance with the abovementioned standard, TRS values mentioned herein involved a test material of a certain length placed on a surface and put under stress until it breaks. The TRS values herein are the average value of several tests. The very low plastic deformation is normally not considered as it occurs only in the toughest carbides.

In one aspect of the present disclosure, there is provided a cemented carbide comprising a hard phase and a binder phase characterized in that the binder phase comprises Ni, the hard phase comprises NbC, $Mo_2C$ and TaC, and wherein the wt % TaC in the cemented carbide is at least 0.3

In particular, the inventors have identified that the recited elemental composition of the cemented carbide provides an enhanced TRS compared to other systems known in the art without compromising the desired and advantageous hardness-toughness characteristics.

The composition of the present cemented carbide may optionally comprise wt % 65-85 NbC; 2-12 $Mo_2C$; 0.3-8 TaC; 1-15 WC; 3-25 Ni. In particular, in some aspects substantially all, a majority or a predominant component in wt % of Nb, Mo, Ta and W are present within the hard phase. That is, in certain embodiments, a minor or relatively low amount of the total wt % of each of Nb, Mo, Ta and/or W may be present outside/beyond the hard phase. Such minor amounts may be present at the grain boundaries between the hard phase and the binder phase or within the binder phase. In other aspects substantially all, a majority or a predominant component in wt % of Mo and W are present within the binder phase. That is, in certain embodiments, a minor or relatively low amount of the total wt % of each of Mo and/or W may be present outside/beyond the binder phase.

According to a further aspect of the present disclosure there is provided a method of making a cemented carbide comprising: preparing a batch of powdered materials including Ni, NbC, $Mo_2C$ and no less than 0.3 wt % TaC; pressing the batch of powdered materials to form a pre-form; and sintering the pre-form to form the article.

Optionally, the powdered materials may be added in any one or in combination of their elemental form, carbide form or mixed carbide form.

According to a further aspect of the present disclosure there is provided a cemented carbide article obtainable by the methods as described and claimed herein.

DETAILED DESCRIPTION

The inventors have identified NbC-based cemented carbide materials having improved TRS and thermal conductivity for alike hardness-toughness levels as some WC-based cemented carbides.

The desired physical and mechanical characteristics are achieved, at least in part, by the selection of the metallic binder. Nickel presents good wettability towards the carbide ensuring a good cohesion of the material, which in turn facilitates sintering process and good mechanical properties. However, the relatively high solubility of NbC in nickel promotes certain NbC grain growth during sintering. In order to limit such grain growth, molybdenum may be added either as elemental and/or carbide form (i.e. Mo, MoC and/or $Mo_2C$). Known NbC—Ni—Mo systems may present mechanical limitations such as low values for TRS and/or thermal conductivity. Surprisingly, however, the inventors have identified that the addition of tantalum, either in its elemental and/or its carbide form, contributes to the enhancement of such properties.

The inventors have identified that such desired physical and mechanical properties may be achieved via a cemented carbide having a wt % composition 65-85 NbC; 3-25 Ni; 2-12 $Mo_2C$; 0.3-8 TaC; and optionally 0-15 WC and/or 0-2 Co.

Optionally, the Ni content in the cemented carbide is at least 3% or at least 5%, by weight. The Ni may be present 3 to 25 wt %, 3 to 20 wt % or 3 to 15 wt % or in a range 5 to 25 wt %, 5 to 20 wt % or 5 to 15 wt %. Such a configuration provides a contribution to the good toughness values whilst maintaining hardness to an appropriate level, as well as high resistance to corrosion.

Optionally, the binder phase of the cemented carbide consists of Ni. In particular, the binder phase comprises exclusively or almost exclusively Ni. However, other components of the cemented carbide may be present as minor wt % components within the binder phase. Reference to such minor wt % components refers to a component at an amount less than 0.1 wt %. Such minor components may be elemental or compound forms of remaining/other constituents of the cemented carbide such as Nb, Mo, Ta and optionally W and/or Co.

Optionally, the NbC content in the cemented carbide is at least 65 wt %, at least 70 wt %, at least 75 wt %, at least 80 wt %. Optionally, the NbC content in the cemented carbide is in a wt % range 65 to 85, 65 to 83 or 65 to 80. Such configurations provide a contribution to the desired hardness and high hot hardness values, galling and adhesion resistance.

Optionally, NbC may be the majority wt % component within the hard phase of the cemented carbide. Reference to the majority wt % component encompasses a mass/weight amount of NbC relative to a mass/weight of any other component present within the hard phase.

Optionally, NbC may be the majority wt % component within the cemented carbide based on mass/weight content as part of the cemented carbide relative to any other component present within the cemented carbide.

Optionally, the $Mo_2C$ content in the cemented carbide is at least 2 wt % or in a range 2 to 14, 2 to 12 or 2 to 10. Such a configuration provides a contribution to the good corrosion resistance, maintains the desired mechanical properties including hardness and toughness and acts as a grain refiner.

Optionally, the TaC content in the cemented carbide is at least 0.3 wt % or in a range 0.3 to 8, 1 to 7 or 2 to 6. Optionally, the TaC content in the cemented carbide is in a range 0.3 to 8, 0.5 to 8, 0.5 to 7.5, 0.5 to 7, 1 to 7, 1.5 to 6.5 or 2 to 6. Such a configuration provides a contribution to the enhanced TRS values as well as thermal conductivity whilst maintaining the desired mechanical properties including hardness and toughness.

Optionally, the cemented carbide is devoid of WC. In particular, the hard phase may comprise exclusively or consist of carbides of Nb, Mo and Ta. Optionally, the cemented carbide comprises WC included at a wt % amount less than any other component of the hard phase and/or the cemented carbide. Optionally, WC may be included as a minority component within the hard phase, the relative amount of which is less than a wt % amount of any one or a combination of NbC, Ni and/or $Mo_2C$. Optionally, WC may be included at less than 15 wt %, 10 wt %, 5 wt %, 2 wt % or 1 wt %.

Optionally, the WC content in the cemented carbide may be at least 1 wt % but less than 15 wt % or in a range 1 to 15 wt %, 1 to 10 wt % or 1 to 5 wt %. Such configurations are determined due to inevitable impurities present in the production of the present NbC-based cemented carbide, using conventional techniques and equipment that is also used for WC-based cemented carbides. Such configurations provide a contribution to the good hardness as well as the thermal conductivity. Additionally, such configurations may contribute, according to certain embodiments, to an increasing effect in the enhancement of TRS achieved by the addition of tantalum and/or tantalum carbide.

Optionally, the cemented carbide is devoid of Co. Preferably, the cemented carbide comprises exclusively Ni to form the binder phase. Optionally, and in some embodiments, Co may be present at an impurity level. Optionally, up to a 2 wt % of the Ni content may be substituted by Co for magnetic purposes only. For certain applications, such as can tooling, some equipment may include magnetic sensors for defect detection. Although one of the objectives of the present disclosure is to provide a cemented carbide free of cobalt, the inventors acknowledge the potential need, under certain circumstances, to provide a NbC-based cemented carbide capable of magnetic detection. Optionally, up to a 2 wt % of the Ni content in the cemented carbide is substituted by Co. Optionally, the Co content in wt % relative to the total mass of the cemented carbide is in a wt % range 0 to 2.0, 0.1 to 2.0, 0.2 to 2.0 0.01 to 1.0 or 0.05 to 0.5.

Optionally, the cemented carbide comprises a binder phase and a hard phase, the binder phase comprising Ni and optionally Co; the hard phase comprising NbC, $Mo_2C$, TaC and optionally WC; and wherein the cemented carbide comprises a balance of NbC.

Optionally, the cemented carbide comprises a binder phase and a hard phase, the binder phase consisting of Ni and optionally Co; the hard phase consisting of NbC, Mo2C, TaC and optionally WC.

Optionally, the cemented carbide consists of a binder phase and a hard phase, the binder phase comprising Ni and optionally Co; the hard phase comprising NbC, $Mo_2C$, TaC and optionally WC. Optionally the cemented carbide comprises a balance of NbC.

Optionally, the cemented carbide comprises a hard phase and a binder phase, the binder phase consisting of Ni and optionally Co; the hard phase consisting of NbC, $Mo_2C$, TaC and optionally WC.

Optionally, the cemented carbide comprises in wt %: 65-85 NbC; 3-15 Ni; 2-10 $Mo_2C$; and 1-7 TaC; and optionally the cemented carbide comprises in wt %: 0 to 15 WC; and 0-2 Co. Optionally, the cemented carbide comprising a balance of NbC.

Optionally, the cemented carbide comprises a hard phase and a binder phase; the binder phase consisting of 3 to 15 wt % Ni and 0 to 2 wt % Co; the hard phase consisting of 65 to 85 wt % NbC, 2 to 10 wt % $Mo_2C$, 2 to 7 wt % TaC and 0 to 15 wt % WC. Optionally, the cemented carbide comprising a balance of NbC.

Optionally, the cemented carbide is devoid of nitrides and/or carbonitrides. Optionally, the cemented carbide comprises exclusively carbides of Nb, Mo, Ta and optionally W. Optionally, the cemented carbide may comprise nitrides and/or carbonitrides present at impurity level. Optionally, the impurity level of such nitrides and/or carbonitrides is less than 0.05, 0.01 or 0.001 wt %.

Optionally, the wt % of NbC in the hard phase is greater than a wt % of any other component of the hard phase. Preferably and compositionally, the majority wt % component of the hard phase is NbC (relative to any other component or element in the hard phase).

Optionally, the cemented carbide is devoid of Ti and carbides, nitrides and/or carbonitrides of Ti. Preferably, the cemented carbide comprises 0 wt % Ti so as to be compositionally free of Ti.

Optionally, the cemented carbide is devoid of nitrogen or nitrogen compounds. However, the cemented carbide may comprise nitrogen or nitrogen compounds such as nitrides at impurity level such as less than 0.1 wt %, 0.05 wt %, 0.01 or 0.001 wt %.

Optionally, the cemented carbide comprises a hard phase and a binder phase; the binder phase consisting of 3 to 15 wt % Ni and 0 to 2 wt % Co; the hard phase consisting of 65 to 85 wt % NbC, 2 to 10 wt % $Mo_2C$, 1 to 7 wt % TaC and 0 to 15 wt % WC. Preferably, the cemented carbide comprising a balance of NbC.

Optionally, the cemented carbide comprises a hard phase and a binder phase; the binder phase consisting of 3 to 15 wt % Ni and 0 to 2 wt % Co; the hard phase consisting of 65 to 85 wt % NbC, 2 to 10 wt % $Mo_2C$, 1 to 6 wt % TaC and 1 to 10 wt % WC. Preferably, the cemented carbide comprising a balance of NbC.

Optionally, the cemented carbide comprises a hard phase and a binder phase; the binder phase consisting of 3 to 15 wt % Ni and 0 to 2 wt % Co; the hard phase consisting of 65 to 85 wt % NbC, 2 to 10 wt % $Mo_2C$, 1 to 6 wt % TaC and 1 to 5 wt % WC. Preferably, the cemented carbide comprising a balance of NbC.

Reference to powdered materials within this specification is to the starting materials that form the initial powder batch for possible milling, optional formation of a pre-form compact and subsequent/final sintering. Referring to the starting material powder batch, optionally, the powdered materials comprise in wt % 65-85 NbC; 3-15 Ni; 2-10 $Mo_2C$; 0.5-8 TaC. Optionally, the powdered materials comprise in wt % 65-85 NbC; 3-15 Ni; 2-10 $Mo_2C$; 1-7 TaC. Optionally, the powdered materials comprise in wt % 65-75 NbC; 3-15 Ni; 2-10 $Mo_2C$; 1-6 TaC. Optionally, the powdered materials comprise in wt % 65-75 NbC; 3-15 Ni; 2-10 $Mo_2C$; 2-6 TaC. Optionally, the powdered materials further comprise WC in a range wt % 0-15; 0-10; 0-5; 1-10; 1-6 or 1-5. Optionally, the powdered materials may further comprise Co in a range wt % 0-2; 0.1-2 or 0.2 to 2.

Optionally, the step of sintering the pre-form to form the article comprises vacuum or HIP processing. Optionally, the sintering processing comprises processing at a temperature 1350-1500° C. and a pressure 0-20 MPa.

Optionally, the step of sintering the pre-form to form the article does not involve adding nitrogen and/or is undertaken in the absence of nitrogen. In particular, sintering of the materials to form the cemented carbide is undertaken specifically with the exclusion of nitrogen that may otherwise be present as nitrides or within a nitrogen containing environment.

Optionally, a carbon content within the sintered cemented carbide is maintained within a predetermined range to further contribute to the good mechanical properties. Optionally, the carbon content of the sintered material may be held in a range between free carbon in the microstructure (upper limit) and eta-phase initiation (lower limit). Such limits will be appreciated by those skilled in the art.

EXAMPLES

Conventional powder metallurgical methods including mixing, pressing, shaping and sintering were used to manufacture various sample grades of a cemented carbide according to the present disclosure. In particular, (fully sintered) cemented carbide grades with wt % compositions according to Table 1 were produced according to known methods. Grades A to F are comparative samples and Grades G to Q are in accordance with the subject disclosure. All samples were prepared from powdered materials forming the hard phase and the binder phase.

Each of the sample mixtures Grades A to F and Grades G to Q were prepared from powdered materials forming the hard constituents and powdered materials forming the binder. The following preparation method corresponds to Grade L of Table 1 below having starting powdered materials: WC 0.548 g, NbC 42.667 g, TaC 2.189 g, $Mo_2C$ 3.290 g, Ni 7.130 g, PEG 1.400 g, ethanol 50 ml. It will be appreciated by those skilled in the art that it is the relative amounts of the powdered materials that allow the skilled person to achieve the fully sintered material and suitable adjustment is needed to make the powdered batch and achieve the final fully sintered composition of the cemented carbides of Table 1. The powders were wet milled together with lubricant and anti-flocculating agent until a homogeneous mixture was obtained and granulated by drying and sieving. The dried powder was pressed to form a green part according to the abovementioned standard shapes and sintered using SinterHIP at 1350-1500° C. and 5 MPa. Table 1 details the composition (wt %) of the various comparative samples A to F and samples G to Q encompassed by the present cemented carbide.

TABLE 1

Example Grade Compositions G to Q and Comparative Grades A to F

| Sample | NbC (wt %) | Ni (wt %) | $Mo_2C$ (wt %) | WC (wt %) | TaC (wt %) |
|---|---|---|---|---|---|
| A (comparative) | 81 | 13 | 4 | 2 | 0 |
| B (comparative) | 81 | 8 | 9 | 2 | 0 |
| C (comparative) | 64 | 13 | 15 | 4 | 4 |
| D (comparative) | 58 | 13 | 9 | 16 | 4 |
| E (comparative) | 45 | 13 | 9 | 29 | 4 |
| F (comparative) | 78 | 13 | 9 | 0 | 0 |
| G | 80.5 | 8 | 9 | 2 | 0.5 |
| H | 75 | 13 | 9 | 2 | 1 |
| I | 75 | 13 | 9 | 1 | 2 |
| J | 75 | 13 | 9 | 0 | 3 |
| K | 78 | 8 | 9 | 2 | 3 |
| L | 76 | 13 | 6 | 1 | 4 |
| M | 70 | 13 | 9 | 4 | 4 |
| N | 68 | 13 | 9 | 4 | 6 |
| O | 70 | 13 | 9 | 0 | 8 |
| P | 72 | 13 | 3 | 4 | 8 |
| Q | 73 | 13 | 6 | 4 | 4 |

Characterization

Hardness tests were carried out according to ISO 3878: 1983; toughness tests according to Palmqvist, ISO 28079: 2009; and transverse rupture strength (TRS) test were carried out according to ISO 3327:2009, the test pieces being of Type A, rectangular cross-section. Vickers indentation test was performed using 30 kgf (HV30) to assess hardness. Palmqvist fracture toughness was calculated according to:

$$K1c = A\sqrt{HV}\sqrt{\frac{P}{\sum L}}$$

Where A is a constant of 0.0028, HV is the Vickers hardness in N/mm2, P is the applied load (N) and ΣL is the sum of crack lengths (mm) of the imprint. The test pieces for transverse rupture strength's determination were beams of Type A (rectangular cross-section with 4×5×45 $mm^3$ dimension). The samples were placed between two supports and loaded in their center until fracture occurred (3-points bending). The maximum load was recorded and averaged over minimum five samples per test. The results are shown in Table 2:

TABLE 2

Hardness, Toughness and Transverse Rupture Strength Values for Samples A to Q

| Sample | HV30 | K1C (MPa$\sqrt{m}$) | TRS (MPa) |
|---|---|---|---|
| A (comparative) | 1325 | 8.8 | 1264 |
| B (comparative) | 1540 | 7.8 | 1121 |
| C (comparative) | 1427 | 8 | 1290 |
| D (comparative) | 1348 | 9 | 1294 |
| E (comparative) | 1341 | 7.9 | 931 |
| F (comparative) | 1387 | 9.6 | 1320 |
| G | 1560 | 8.1 | 1230 |
| H | 1393 | 8.9 | 1400 |
| I | 1391 | 9.4 | 1420 |
| J | 1373 | 9.7 | 1460 |
| K | 1560 | 8.5 | 1540 |
| L | 1300 | 9.9 | 1356 |
| M | 1368 | 9 | 1530 |
| N | 1353 | 9.2 | 1604 |
| O | 1363 | 9.6 | 1554 |
| P | 1305 | 9.5 | 1500 |
| Q | 1300 | 9.8 | 1600 |

Referring to Table 2, Sample G has a hardness HV30 of about 1560, a toughness K1c of 8.1 MPa·$\sqrt{m}$ and a TRS of about 1390 MPa. From comparative B, it can be observed that the addition of TaC, whilst maintaining the same amounts of the remaining components, provides an increased TRS. There is evidence of a substantial jump of over 100 MPa with the addition of a small amount (i.e., around 0.5 wt %) of TaC.

It is also noted from Table 2 that Sample H has a hardness HV30 of about 1393, a toughness K1c of 8.6 MPa·$\sqrt{m}$ and a TRS of about 1400 MPa. Comparing comparative A and B with sample G, it is observed that the addition of TaC also provides a TRS increase. In this case, it is noted that there are variations in the amount of Ni and NbC compared to sample G. However, the addition of tantalum to the composition provides a clear positive effect to enhance the TRS from 1264 MPa (sample A) to 1400 MPa (sample H). Moreover, the technical effect associated with the presence of TaC in the composition can also be noted from comparative F and sample J. Comparative F does not comprise WC nor TaC and has a TRS value of about 1320 MPa. On the other hand, sample J achieves a TRS value of about 1460 MPa without compromising the good hardness-toughness values.

Sample Q has a hardness HV30 of about 1300, a toughness K1c of 9.8 MPa·$\sqrt{m}$ and a TRS of about 1600 MPa. The detrimental effect of surpassing the higher limit of $Mo_2C$ can be observed using comparative C, which has a hardness HV30 of about 1420, a toughness K1c of 8 MPa·$\sqrt{m}$ and a TRS of about 1290 MPa. The amount of molybdenum present in the composition is such that a separate hard phase of $Mo_2C$ may precipitate, with this being detrimental to achieve the desired physical and mechanical characteristics of the present cemented carbide materials.

The potential beneficial effect of incorporating relatively small amounts of WC is also noted from Tables 1 and 2. In particular, sample M presents a TRS value of about 1530 MPa, having a 4 wt % WC as well as a 4 wt % TaC. However, from comparatives D and E it can be observed how the addition of WC in wt % amounts such as 16 or higher provides significantly lower TRS values i.e., 1294 MPa (comparative D) and 931 MPa (comparative E).

Unless defined otherwise all technical and scientific terms used herein have the same meaning as commonly understood to one of ordinary skill in the art to which the presently described subject matter pertains.

Unless otherwise indicated, any reference to "wt %" refers to the mass fraction of the component relative to the total mass of the cemented carbide.

Where a range of values is provided, for example, concentration ranges, percentage range or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

It should be understood that the terms "a" and "an" as used above and elsewhere herein refer to "one or more" of the enumerated components. It will be clear to one of ordinary skill in the art that the use of the singular includes the plural unless specifically stated otherwise. Therefore, the terms "a", "an" and "at least one" are used interchangeably in this application.

Unless otherwise indicated, all numbers expressing quantities of ingredients, properties such as size, weight, reaction conditions and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present subject matter. At the very least, and not as an attempt to limit the application of the doctrine of equivalents to the scope of the claims, each numerical parameter should at least be construed in light of the number of reported significant digits and by applying ordinary rounding techniques.

Throughout the application, descriptions of various embodiments use "comprising" language; however, it will be understood by one of skill in the art that, in some instances, an embodiment can alternatively be described using the language "consisting essentially of" or "consisting of".

The present subject matter being thus described, it will be apparent that the same may be modified or varied in many ways. Such modifications and variations are not to be regarded as a departure from the spirit and scope of the present subject matter, and all such modifications and variations are intended to be included within the scope of the following claims.

The invention claimed is:

1. A NbC-based composition, consisting of:

NbC in an amount of from 65 wt. % to 75 wt. %, $Mo_2C$ in an amount of from 2 wt. % to 12 wt. %, TaC in an amount of from 2 wt. % to 6 wt. %, and WC in an amount less than 5 wt. %; and Ni in an amount of from 3 wt. % to 15 wt. % and Co in an amount of from 0 wt. % to 2 wt. %.

2. The NbC-based composition according to claim 1, wherein the $Mo_2C$ is present in an amount of from 2 wt. % to 10 wt. %.

3. A tool for wire drawing, comprising the NbC-based composition according to claim 1.

4. A tool for metal cutting, comprising the NbC-based composition according to claim 1.

5. A method of making a NbC-based article with a composition according to claim 1, comprising:

preparing a batch of powdered materials consisting of Ni in an amount of from 3 wt. % to 15 wt. %, NbC in an amount of from 65 wt. % to 75 wt. %, $Mo_2C$ in an amount of from 2 wt. % to 12 wt. %, TaC in an amount of from 2 wt. % to 6 wt. %, Co in an amount of from 0 wt. % to 2 wt. %, and WC in an amount less than 5 wt. %;

pressing the batch of powdered materials to form a pre-form; and sintering the pre-form to form the NbC-based article.

* * * * *